United States Patent [19]

Ricci et al.

[11] 4,195,794

[45] Apr. 1, 1980

[54] REEL HOLDER WITH DRAG

[76] Inventors: John D. Ricci, 301 W. 6020 South, Murray, Utah 84107; John S. Grant, 2674 Alden St., Salt Lake City, Utah 84106

[21] Appl. No.: 960,246

[22] Filed: Nov. 13, 1978

[51] Int. Cl.[2] ..... B65H 17/44; B65H 75/40

[52] U.S. Cl. ..... 242/99; 242/96

[58] Field of Search ..... 242/96, 99, 100

[56] References Cited

U.S. PATENT DOCUMENTS

| | | | |
|---|---|---|---|
| 1,067,643 | 7/1913 | Christner | 242/99 |
| 2,923,490 | 2/1960 | Smith | 242/99 X |
| 3,006,574 | 10/1961 | Hardy | 242/96 |
| 3,095,159 | 6/1963 | Stacy | 242/96 |
| 3,589,634 | 6/1971 | Mason | 242/96 |
| 4,082,235 | 4/1978 | Dauvergne | 242/96 X |

*Primary Examiner*—Edward J. McCarthy
*Attorney, Agent, or Firm*—M. Reid Russell

[57] ABSTRACT

The present invention is a reel holder with drag, consisting of a hub whereon can be journaled a conventional reel having single or multiple strands of small gauge wire wound thereon, having therewith, integral to the hub, a drag or brake wherewith an operator can control reel turning, the hub preferably including a clip for mounting to an operator's belt, belt loop, or a handle to be held by an operator.

11 Claims, 5 Drawing Figures

REEL HOLDER WITH DRAG

BACKGROUND OF THE INVENTION

1. Field of the Invention

This invention relates to devices for maintaining and braking a conventional reel from which reel wire or cable is dispensed therefrom.

2. Prior Art

Hub arrangements for journaling a reel having wire or cable wound thereon are, of course, well-known. Examples of hub arrangements for carrying reels containing light gauge wire are shown in U.S. Pat. Nos. 2,982,491 and 2,542,580, with some examples of hub arrangements for maintaining reels carrying lines, tapes, or the like, shown in U.S. Pat. Nos. 3,481,557; 3,731,887; and 3,589,634. Of the above-cited patents, U.S. Pat. Nos. 3,589,634 and 3,731,887, similar to the present invention, involve drag arrangements where a wire, line or cable reeled therefrom is passed over a collar or shoulder, dragging thereagainst, to slow the reeling process, which arrangements are unlike the present invention.

A different drag arrangement from those shown above is found in U.S. Pat. No. 3,095,159 that involves a surgical dispenser arranged to provide a braking to material moved therefrom by creating a frictional resistance between reel and disk portions, the reel portion canting against the disk portion to limit reel turning. The present invention, similar to U.S. Pat. No. 3,095,159, involves a radially projecting disk from which an integral hub portion projects at a normal angle. The present invention, unlike this arrangement, incorporates as the brake, in one embodiment, shoulders formed at the hub end and at the junction of the hub and radially projecting disk. So arranged, by canting of the reel, the side thereof will contact both shoulders, friction of that contact providing a brake. In another drag embodiment, the present invention provides for a tapering of the hub itself establishing thereby a constant resistance to reel turning, which arrangement is also unlike any prior device within the knowledge of the inventors.

Further, the present invention also, optionally, includes inclusion of a washer or washer-like device between a reel side and the radially projecting disk. This washer or washer-like device contacts the reel side as it turns, binding thereagainst, as an operator cants the present invention, including the reel, with respect to a strand of wire or cable unrolling thereoff, providing a braking action. The hub and disk arrangement of the present invention preferably also includes, alternatively, a clip for attachment over an operator's belt, a continuous belt loop, or a handle formed thereto, which arrangements each extend outwards from the radially projecting disk, opposite to the hub. While a clip-on arrangement is shown in U.S. Pat. No. 3,589,634, this arrangement is distinguishable from the clip of the present invention, as it does not appear to involve, as does the present invention, a biased clip having a portion thereof that is urged into engagement to a belt. The clip is hooked over, maintaining a positive engagement thereto.

Within the knowledge of the inventors, there has not heretofore existed a reel holder with drag like that of the present invention and, therefore, the present invention is believed to be both novel and unique and a significant improvement in the art.

SUMMARY OF THE INVENTION

It is the principal object of the present invention to provide a hub arranged to receive a conventional reel journaled thereover, and providing a manually operated drag arrangement associated therewith for controlling reel turning.

Another object of the present invention is to provide an arrangement for maintaining the hub and a radially projecting disk from which the hub projects by an operator while wire, cable or the like is turned off the reel journaled thereon.

Another object of the present invention is to provide, as a drag for restricting reel turning, shoulders arranged on either end of the hub for engagement with opposite reel sides, proximate to a center opening therethrough, whereby, by an operator canting the device from the line of wire or cable unrolled from the reel journaled thereon, portions of the reel sides will drag against the shoulders providing a friction braking thereto.

Still another object of the present invention is to provide, as a drag, a tapering of the hub from a diameter at the hub end opposite to the radially projecting disk that is greater than is the diameter of a reel to be journaled thereover to a lesser diameter, hub sections arranged to flex at the greater diameter inwardly along slots or keepers so as to fit within said reel opening for resisting reel turning.

Still another object of the present invention is to provide an integral hub and radially projecting disk with clip, belt loop, or handle that can be manufactured as a single unit.

Still another object of the present invention is to provide a device having integral component parts that are inexpensively molded of a flexible resiliant material, such as a polyethylene or a polypropylene plastic.

Principal features of the present invention in a reel holder with drag include a hub, and integral thereto, a radially projecting disk that extends across one hub end. The opposite hub end is flanged to a peak and, preferably, has a plurality of longitudinal slots or keepers formed therein that extend along that hub to allow for an inward flexure of the flange end when a conventional wire reel, or the like, is journaled thereover. To the radially projecting disk face opposite to its connection to the hub is optionally arranged a clip for securing the assembly to an operator's belt, a belt loop for receiving the operator's belt therethrough or a handle whereby an operator can hold the device.

The present invention provides, in one embodiment, a drag formed as shoulders at both hub ends, which shoulders engage a turning reel faces. An additional embodiment of a drag of the present invention involves forming the hub so as to have a diameter that is greater at one end than is the opening through the conventional reel wherethrough said hub is journaled, the hub tapering therefrom to a diameter that is lesser than the reel opening diameter. So arranged, when the reel is fitted over the hub surfaces of greater diameter, sections thereof alongside longitudinal slots or keyways formed therein are depressed inwardly, a spring action of the hub material urging these hub sections against the wall of the reel opening, providing a resistance to reel rotation.

The above tapered hub can be used along as the drag or can be included with the described shoulders. Also, an additional drag embodiment, taught by the present invention, includes arranging a washer between the radially projecting disk and reel surface proximate thereto, the washer surfaces providing a friction force to the disk and reel surfaces when the assembly is canted appropriately. Also, the washer can have an abrasive face or faces formed therein to further provide a friction resistance to reel turning, as desired.

Operation of the shoulder and washer drag embodiments described above involve an operator, who by canting the assembly from a normal angle to the line of the wire or cable unreeling from the reel, causes the reel sides to press against the shoulders, and/or washer, increasing friction thereat to restrict reel turning. The amount of canting by the operator thereby controls reel braking.

The hub, radially projecting disk and clip, belt loop, or handle are preferably integral and formed as a single piece, preferably by molding methods, from a resilient plastic or plastic-like material, such as a polyethylene or polypropylene. Though, of course, the present invention could be formed by other methods from a metal or other conventional material.

Further objects and features of the present invention will become more apparent from the following detailed description, taken together with the accompanying drawings.

THE DRAWINGS

FIG. 1 is a profile perspective view of a reel mounted to the hub of the present invention showing a portion of that reel broken away, exposing a spring clip back thereof that extends from a radially projecting disk integral to the hub;

FIG. 2, a side elevation view of the spring clip and radial projecting disk of FIG. 1, showing, in broken lines, the hub extending from that radially projecting disk with the reel journaled thereto;

FIG. 3, a sectional view taken along the line 3—3 of FIG. 2, showing the integral hub, radially projecting disk, and clip as formed in one piece of a plastic material, with the hub shown as tapering from a greater diameter at a flanged end to a lesser diameter, a washer shown arranged between a reel side and a face of the radially projecting disk;

FIG. 4, a view like that of FIG. 2 only showing the radially projecting disk as having a handle secured thereto that also could be taken as being a belt loop; and FIG. 5, a sectional view taken within the intersecting lines 5—5 of FIG. 4, showing the hub, radially projecting disk and handle as being integral to one another and formed as a single unit with a reel portion shown journaled on the hub.

DETAILED DESCRIPTION

Figure 1:
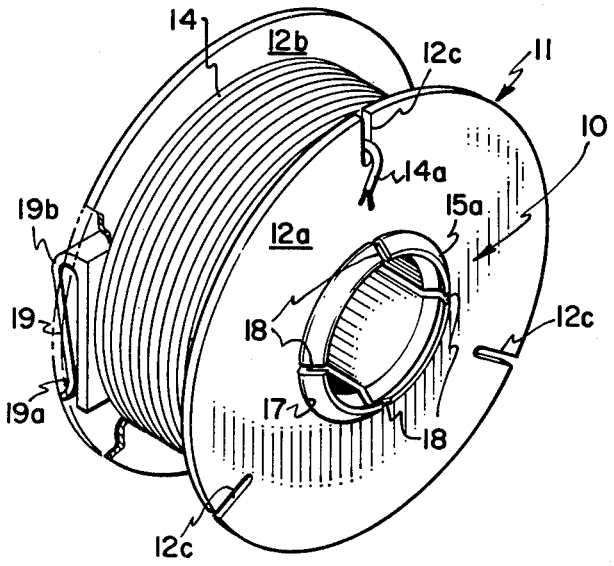
Figure 3:
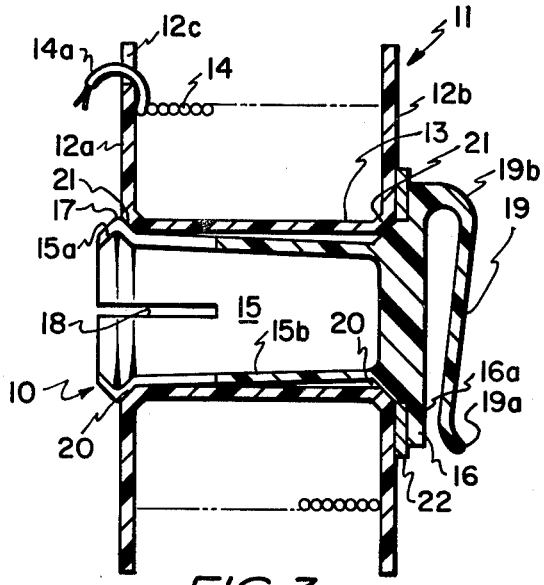
Figure 4:
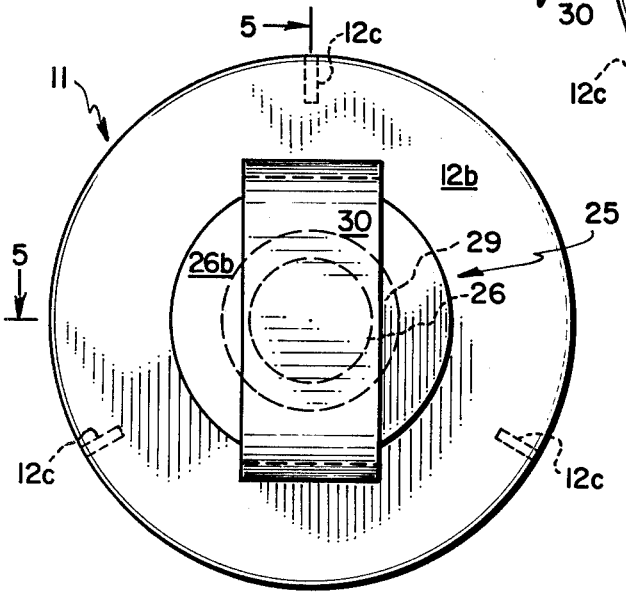

Referring now to the drawings:

In FIG. 1 is shown a perspective view of the present invention in a reel holder with drag 10, hereinafter referred to as holder. The holder 10 is shown journaled through a lateral opening or core 13 of a standard wire or cable carrying reel 11. Reel 11, as shown best in FIG. 3, consists of outer walls **12*a* and 12*b* with core 13 therebetween. Shown in FIGS. 1 and 3, reel 11 preferably carries wire or cable 14 wound thereon that, as the present invention is inteded to be manually manipulated by an operator, not shown, should be understood to be a light gage wire or cable that could conceivably be a single or a multiple strand. Reel 11 is shown in FIGS. 3 and 4 to be formed of plastic though, of course, it could be formed of a metal or other convenient material. While core 13 is shown to be formed as a straight cylinder between outer walls 12*a* and 12*b*, it should be understood that the core could be shaped differently, having, say, a greater diameter than that of the opening through reel outer walls 12*a* and 12*b*, or the like. In such configuration the edges of the opening through outer walls 12*a* and 12*b* would contact and provide a friction force against an appropriate drag associated with the present invention, as will be described in detail later herein. A cable 14 with end 14*a* is preferably maintained until wound therefrom in a slot keeper 12*c* formed in reel flange 12*a***, with the other cable end located at the core of the reel.

The present invention in holder 10 consists of a hub 15 that is preferably integral to and formed by molding methods with a radially projecting disk 16 that extends at a normal angle across one end thereof. The opposite hub end **15*a*, as shown best in FIG. 3, is preferably flanged outwardly to a peak 17 that has a greater diameter thereat than the diameter of core 13 through reel 11. To provide for an inward flexure of hub sections at the hub peak 17 to allow the reel 11 to be journaled thereover, slots or keepers 18 are formed longitudinally along the hub 15 extending to approximately a midpoint thereof. The slots or keepers 18 provide for an inward flexure of the hub sections therebetween, as reel 11 is fitted thereover. The hub sections preferably have sufficient elasticity to flex back to the attitude shown in FIG. 3, with peak 17 thereby locking the reel 11 to the hub 15**.

Figure 2:
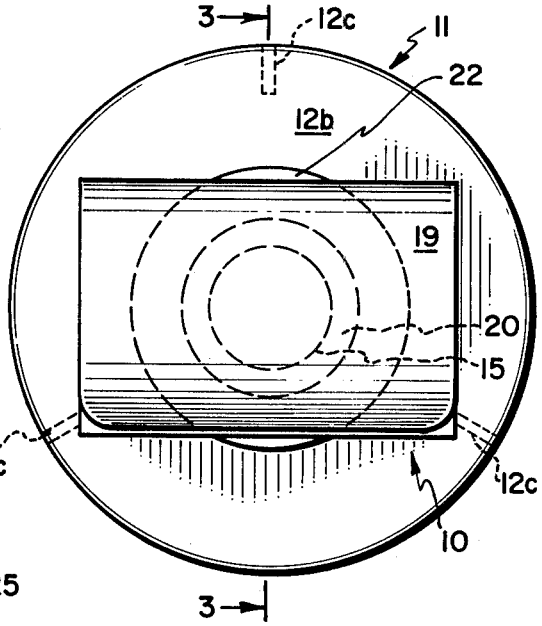

In the embodiment of FIGS. 1 through 3, a clip 19 is preferably incorporated to the radially projecting disk 16, extending outwardly from a face thereof opposite to hub 15. Clip 19 preferably has a bend formed proximate to end **19*a* thereof for aiding its slide over an operator's belt, not shown. The clip 19 is preferably formed of a material such that it is capable of flexure around a bend 19*b* proximate to a face 16*a* of radially projecting disk 16**.

As stated above, the hub 15, radially projecting disk 16 and clip 19 are preferably integral and preferably formed by molding methods from a flexible and resiliant material, such as a polyethylene or polypropylene plastic, or a like flexible material. However, it should be understood that, the above elements of the present invention could be manufactured separately, from any convenient material and then assembled, without departing from the subject matter coming within the scope of this disclosure.

The present invention in a holder 10 also includes a drag arrangement for providing braking to reel 11 to prohibit its "free wheeling" such that the wire could, without control, unwind therefrom. Shown in FIG. 3 are several preferred drag arrangements, a first consisting of shoulders 20, that are formed, respectively, one at the junction of the hub flange end **15*a* with a straight portion 15*b* thereof, and a second formed at a junction of hub 15 to the radially projecting disk 16. So arranged, a flat angle portion 21 of reel 11 formed at the junction of reel flange sides 12*a* and 12*b* to the core 13, can be moved into binding engagement with shoulders 20, as by an operator, not shown, pivoting the hub and journaled reel across the direction or line that wire 14 is being unreeled from reel 11. A friction is thereby created between angle portions 21 and shoulders 20**, providing a braking action of the reel turning on the hub.

Obviously, while two such shoulders 20 are shown as a preferred arrangement, the invention could involve only one shoulder 20, which arrangement, of course, would be less efficient, but would still come within the scope of this disclosure.

Shown also in FIG. 3 is another embodiment or configuration of a drag arrangement that can be incorporated with the above-described shoulders 20, or could be employed alone as a drag with the hub and radially projecting disk. Shown therein, the hub body **15*b* is preferably tapered uniformly from a greater diameter proximate to flanged end 15*a* to a lesser diameter at the hub junction with the radially projecting disk 16. So arranged, to allow for journaling of reel 11 onto hub 15, the slots or keepers 18 are formed therein allowing hub section therebetween to flex inwardly sufficiently to allow the reel core 13 to pass thereover, whereafter the spring action of these hub sections moves them against the interior wall of core 13**, establishing a constant friction force therebetween that acts as a constant reel drag or braking.

Shown also in FIG. 3, a washer 22 can be installed or can be integrally formed in the molding process between the reel wall **12*b* and face of radially projecting disk 16 wherefrom hub 15 projects. So arranged, when the hub 15, radially projecting disk 16, and the reel 11 are canted with respect to wire 14, as described earlier herein, the reel wall 12*b* will press against washer 22, providing thereby a friction force that is resistive to reel 11 turning. Also, the amount of which resistance to turning or reel braking can be increased by providing a roughened surface on one or both sides of washer 22**.

Figure 5:
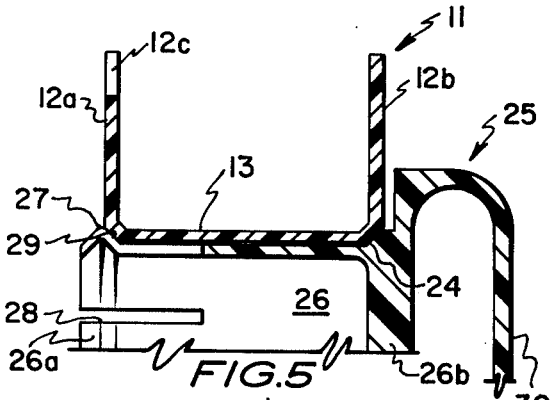

In FIGS. 4 and 5 are shown another embodiment of a reel holder with drag, hereinafter referred to as holder 25, for installation through the core 13 of the conventional wire or cable reel 11. Shown therein holder 25 is essentially like holder 10, having a hub 26 that is essentially like the described hub 15, also includes an outwardly flanged end **26*a* that comes to a peak 27, having longitudinal slots 28 formed therein that also are intended to provide for inward flexure of adjacent hub body sections to allow reel core 13 to pass thereover. Shoulders 29 are preferably arranged on each hub 26 end to provide as described with respect to FIG. 3, for reel braking, and although not shown, it should be understood that hub 26 could also be tapered to provide resistance to reel 11 turning, as described with respect to FIG. 3, and could also include a washer 22, like that shown and described with respect to FIG. 3. Distinctive from the holder 10 of FIGS. 1 through 3, holder 25 rather than including clip 19, incorporated a handle 30 that formed to project outwardly from radially projecting disk 26*b*, for holding by an operator, not shown. Additionally, handle 30 could receive an operator's belt, not shown, therethrough in lieu of being hand held. The functioning of the holder 26, with all or select drag configurations therewith, should be understood to function as described with respect to holder 10 of FIGS. 1 through 3**, excepting that it can be hand held or have an operator's belt fitted therethrough.

The holder 25 of FIGS. 4 and 5, like the earlier described holder 10, should be understood to preferably be integral and molded in one piece of a resilient material such as a polyethylene or polypropylene plastic.

As the holders 10 and 25, described hereinabove, are preferably formed from an inexpensive plastic material, by mass production methods, it should be obvious that they can be cheaply manufactured, could be disposal, though, of course, they can obviously be reused.

Although preferred embodiment of our invention in a reel holder with drag have been disclosed herein, it should be understood that the present disclosure is made by way of example and that variations are possible without departure from the subject matter coming within the scope of the following claims, which claims we regard as our invention.

We claim:

1. A reel holder with drag comprising, a hub arranged for journaling through a core of a wire reel, which hub is tapered from a diameter greater than that of said wire reel core to a diameter less than that of said wire reel core as a drag means for engaging the interior of said reel core exerting a friction force thereagainst;

means for securing, in journaled arrangement, said hub through said wire reel core;

a radially projecting disk that extends across a hub end;

means for controlling, by an operator, the attitude of said hub and radially projecting disk; and spring means associated with said hub for providing an outward biasing of portions of said hub such that they bind against the interior wall of said wire reel core.

2. A reel holder with drag as recited in claim 1, wherein the means for securing said hub through said wire reel core consists of, a flanged end formed on the hub that has a peak whose diameter is greater than that of said wire reel core; and a plurality of longitudinal slots formed in said hub.

3. A reel holder with drag as recited in claim 1, wherein the means for controlling the attitude of said hub and radially projecting disk consists of, a clip secured to said radially projecting disk opposite to said hub.

4. A reel holder with drag as recited in claim 1, wherein the means for controlling the attitude of said hub and radially projecting disk consists of, a handle secured to a face of said radially projecting disk opposite to said hub.

5. A reel holder with drag as recited in claim 1, wherein the means for controlling the attitude of said hub and radially projecting disk consists of, a belt loop secured to a face of said radially projecting disk opposite to said hub.

6. A reel holder with drag as recited in claim 1, wherein the hub, radially projecting disk, and means for controlling the attitude of said hub and radially projecting disk are integral and are manufactured by conventional molding methods from a resiliant material.

7. A reel holder with drag as recited in claim 1, wherein the spring means consists of, a plurality of longitudinal slots formed in said hub along that portion thereof that has a diameter greater than that of the wire reel core; and the hub is formed of a resiliant material such that the hub sections adjacent to said longitudinal slots can flex.

8. A reel holder with drag as recited in claim 1, further including a shoulder as a drag means secured to said hub to contact said wire reel, a surface of said reel to bind thereagainst when the present invention is canted appropriately for providing a resistance to reel turning.

9. A reel holder with drag as recited in claim 8, wherein, shoulders as drag means are secured to both ends of said hub.

10. A reel holder with drag as recited in claim 1, further including, a washer means arranged between the face of the radially projecting disk, from which face the hub projects, and a side of the wire reel that is adjacent thereto when said wire reel is journaled on said hub for providing a resistance to wire reel turning when said hub and wire reel are canted appropriately.

11. A reel holder with drag as recited in claim 10, wherein, the washer means has a roughened surface on one face thereof.

* * * * *